US008109178B2

(12) United States Patent
Santa Ana

(10) Patent No.: US 8,109,178 B2
(45) Date of Patent: Feb. 7, 2012

(54) SIDE-LOAD NAIL HOLDING HAMMER

(76) Inventor: Roland C. Santa Ana, Rockville, MD (US)

( * ) Notice: Subject to any disclaimer, the term of this patent is extended or adjusted under 35 U.S.C. 154(b) by 0 days.

(21) Appl. No.: 10/542,990

(22) PCT Filed: Jan. 21, 2003

(86) PCT No.: PCT/US03/01768

§ 371 (c)(1),
(2), (4) Date: Jul. 21, 2005

(87) PCT Pub. No.: WO2004/067231

PCT Pub. Date: Aug. 12, 2004

(65) Prior Publication Data

US 2006/0048608 A1 Mar. 9, 2006

(51) Int. Cl.
*B25D 1/04* (2006.01)
*B25D 1/06* (2006.01)

(52) U.S. Cl. ..... 81/23; 81/24; 254/26 R

(58) Field of Classification Search ..... 81/23, 20, 81/24, 25, 44; 30/308; 7/144, 146; 254/26, 254/26 R; 279/43
See application file for complete search history.

(56) References Cited

U.S. PATENT DOCUMENTS

| | | | | | |
|---|---|---|---|---|---|
| 83,897 | A | * | 11/1868 | Zimmerman | 7/146 |
| 418,539 | A | * | 12/1889 | Stark | 81/24 |
| 2,597,876 | A | * | 5/1952 | Kurkjian Yervant H | 81/23 |
| 2,671,483 | A | * | 3/1954 | Clark | 81/24 |
| 2,983,297 | A | * | 5/1961 | Wilson | 81/21 |
| 3,877,826 | A | * | 4/1975 | Shepherd et al. | 403/267 |
| 4,723,582 | A | * | 2/1988 | Caspall | 144/358 |
| 4,831,901 | A | * | 5/1989 | Kinne | 81/25 |
| D308,007 | S | * | 5/1990 | Ferguson et al. | D8/75 |
| 5,178,048 | A | * | 1/1993 | Matechuk | 81/125 |
| D353,758 | S | * | 12/1994 | Frykman | D8/78 |
| D376,087 | S | * | 12/1996 | Spirer | D8/75 |
| 6,062,108 | A | * | 5/2000 | Rosero | 81/24 |
| D429,985 | S | * | 8/2000 | Tovar | D8/78 |
| D431,987 | S | * | 10/2000 | Staton | D8/75 |
| D432,380 | S | * | 10/2000 | Goble et al. | D8/78 |
| 6,283,449 | B1 | * | 9/2001 | Hu | 254/26 R |
| 6,332,376 | B1 | * | 12/2001 | Hurley | 81/23 |
| 6,339,974 | B1 | * | 1/2002 | Kotschner et al. | 81/24 |
| 6,460,430 | B2 | * | 10/2002 | Coonrad | 81/20 |
| D465,714 | S | * | 11/2002 | Stump et al. | D8/75 |
| 6,571,666 | B1 | * | 6/2003 | Te | 81/24 |
| 6,598,858 | B2 | * | 7/2003 | Santa Cruz et al. | 254/26 R |
| D478,266 | S | * | 8/2003 | Chen | D8/78 |
| 6,615,691 | B2 | * | 9/2003 | Coonrad | 81/20 |
| D497,789 | S | * | 11/2004 | Hung | D8/78 |
| D503,605 | S | * | 4/2005 | Hung | D8/78 |
| D505,609 | S | * | 5/2005 | Hung | D8/79 |
| D530,583 | S | * | 10/2006 | Chen | D8/78 |
| D534,409 | S | * | 1/2007 | Chen | D8/78 |

* cited by examiner

*Primary Examiner* — David B Thomas
(74) *Attorney, Agent, or Firm* — Hoang Steve Ngo

(57) ABSTRACT

An ergonomic side-load nail holding hammer for the industry of striking tools and hammers. It comprises a magnetic hammerhead including a multinail holder and starter, with half conical shaped vertical slots (such as 1*a*, 1*b*, 1*c*, 1*d*, 1*e*) with magnets (9) and self-releasing groove. It also permits nails to be straightened when hammered. It has curved shaped claws (6) for digging nails and preventing damage to the surface where the nail is located. The claw body (7) has a curved shape and the claws have a small claw end (5*a*) and a larger claw end (5*b*). The neck includes an indentation (3).

29 Claims, 3 Drawing Sheets

FIG. 1
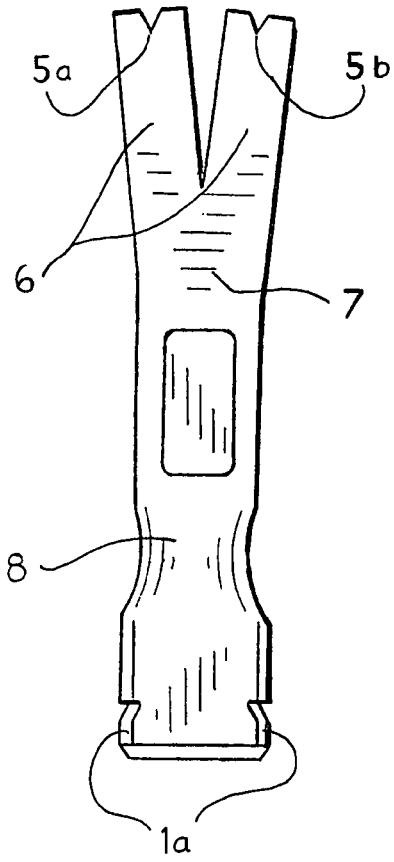
FIG. 2
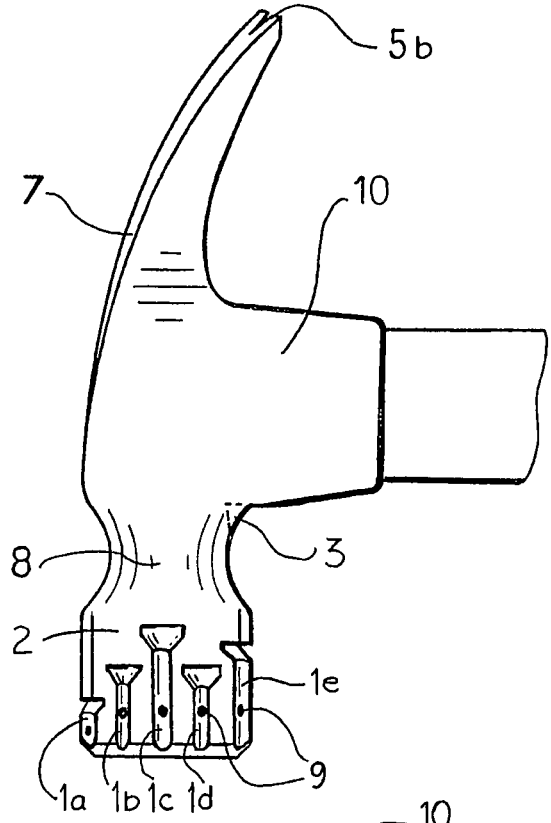
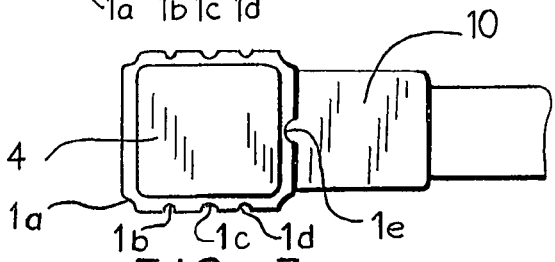
FIG. 3

SIDE-LOAD NAIL HOLDING HAMMER

TECHNICAL FIELD

This invention relates in general to hammers, in particular to nail & claw hammers and tack hammers. This invention is a novel ergonomic hammer that includes a multi-nail holder, slots that enable nails to be straightened when being struck or hammered, and curved claws for nail digging.

BACKGROUND ART

The prior art has diverse examples of nail and claw and tack hammers, all achieving distinct purposes. Nevertheless, none of the inventions present in the prior art disclose the invention subject of this application: a hammer that may magnetically retain or attract nail(s) of different size, length and width. In addition, many of the hammers in the prior art have the problem that a nail head may get caught with the head of the hammer during an up swing for striking or that the hammer head with a nail holding structure may get damaged during missed strikes to pointy objects or nails themselves, thus becoming dangerous.

U.S. Pat. No. 6,435,059 B1 (Martinez, 2002) describes a light-weight striking tool. The invention in the prior art includes a nail holder groove of magnetic qualities for holding a nail for easy setting. This invention differs from the side-load nail holding hammer because the nails that can be retained by the hammer in the prior art are limited in number, size and length, unlike the side-load nail holding hammer for various numbers of nails. In addition, the side-load nail holding hammer has nail slots of a half cone design. U.S. Pat. No. 6,339,974 B1 (Kotschner et al, 2002) pertains to a carpenter hammer with a hammerhead with a nail holder. U.S. Pat. No. 6,332,376 (Hurley, 2001) describes a hammer with replaceable nail striking head. U.S. Pat. No. 6,301,996 (Crawford, 2001) pertains to a nail-starting hammerhead. U.S. Design Pat. No. 438,082 (Stegner, 2001) concerns a hammer. U.S. Pat. No. 5,894,764 (Hanlon, 1999) is for a hammer with nail-holding structure. U.S. Pat. No. 4,465,115 (Palomera, 1984) is for a hammerhead. U.S. Pat. No. 4,193,433 (Siclder, 1980) is for a nail holding hammer. PCT published international patent application No. WO 01/12392 (August, 2001) discloses a lightweight striking tool. As in the previous examples, these prior art inventions can be applied only to nails of limited sizes, unlike the side-load nail holding hammer. In addition, in the particular case of U.S. Pat. No. 4,193,433, the nail head may get caught in the hammer claw at striking said tool, a disadvantage not shared by the side-load nail holding hammer. In addition, the side-load nail holding hammer has nail slots of a half-cone design, therefore having nail slots of a different shape.

U.S. Pat. No. 5,988,020 (Johnson, 1999) discloses a hammerhead used for magnetically holding nails of different sizes and lengths. This device does not permit the hammer to magnetically attract and retain several nails of different size, length and width for striking or hammering. In addition, this invention has a U-shaped striking bar, which may have to be replaced in the future. This problem is not present in the side-load nail holding hammer invention subject of this patent application. Moreover, this prior art invention does not magnetically attract the nails in the same manner as the side-load nail holding hammer does. The side-load nail holding hammer has numerous half cone shaped vertical slots in its face and back throat, for nails to be inserted therein. These nails are magnetically attracted to the small magnets placed on the sides of such slots. Therefore, these slots with the small magnets serve to magnetically attract the nails, thus acting as nail holders and nail starters.

U.S. Pat. No. 4,561,635 (Lamansky, 1985) discloses a nail-removing hammer. The side-load nail holding hammer has claw ends that also permit the removal of nails. In addition, the side-load nail holding hammer has claws that differ in shape from the hammer in the prior art for the side-load nail holding hammer has curved claws that dig deeper into the nail head.

U.S. Pat. No. 6,283,449 (Hu, 2001) discloses a hammer with a nail digging function. This hammer does not share the same shape of claw as the side-load nail holding hammer for the latter has curved shaped claws. In addition, due to the fact that both claws of the Hu invention are in line, one of the Hu hammer claws may obstruct the second while removing a nail, problem that is not encountered by the side-load nail holding hammer. Therefore, the side-load nail holding hammer protects surfaces from damage by any of its own claws.

Therefore, the present novel invention differs from those in the prior art because it permits numerous nails of different size, length or width to be placed in the half conical shaped slots in the hammer face and back throat, retained magnetically, and ready to be struck on a surface. In addition, it includes a hammerhead with a curved claw body, curved claws enabling removal of nails without damaging the nailed surface, and an indentation in the neck of the hammer.

DISCLOSURE OF THE INVENTION

The present invention embodies a novel ergonomic side-load nail holding hammer. The elements of this invention are a striking tool or hammer comprised of:

a) A handle.

b) A hammerhead having an eye (10), a pair of curved claws (6), a curved claw body (7), throat (8), neck with an indentation (3) and striking face (2). The curved claws (6) have a small curved claw end (5*a*) and a larger curved claw end (5*b*), both to be used for nail digging and removal.

c) Having said face (2) and throat (8) a nail holder and nail starter comprised of numerous half conical shaped vertical slots (such as 1*a*, 1*b*, 1*c*, 1*d*, 1*e*) permitting placement of numerous nails of diverse size, length and width; and having small magnets (9) attached or drilled on their sides, which shall magnetically attract the nails to the sides of such slots.

OBJECTS AND ADVANTAGES OF THE INVENTION

The present invention constitutes a significant improvement in several aspects over such previously identified efforts of the prior art as described below.

An object of the present invention is to provide a novel hammer of ergonomic design for it includes a multinail holder and nail starter with vertical slots (such as 1*a*, 1*b*, 1*c*, 1*d*, 1*e*) at the side of the hammerhead throat (8) and face (2). Prior art hammers locate nail holder and/or starters at the top of the hammerhead or at the end of the hammer handle. Therefore, user may initially nail by striking the nail starter in those locations, and thereby continue nailing with the hammer face. However, it is awkward for user to change striking positions and therefore nailing is not done in the most efficient way. Thus, this novel invention solves the aforementioned problem, for user will use the side load nail starter and continue striking the nail, handling the hammer or striking tool in the same manner as when initially held. Hence, user shall perform nail starting, initial nailing and continued nailing in an ergonomic or natural manner, making this an efficient tool for hammering a nail in a comfortable way for user and preventing physical injury to users wrist and elbow.

Another object of the present invention is to present us with a side-load nail holding hammer with a nail holder and nail starter capable of retaining or attracting and starting numerous quantities of nails of different size, width and length. The nail slots have a characteristic half cone design.

Yet another advantage of this invention is that it includes a nail-straightening slot. The half conical shaped vertical slots (such as 1*a*, 1*b*, 1*c*, 1*d*, 1*e*) not only hold the nails for hammering and serve as a nail starter, but also maintain the nails in a straight position and therefore straighten them when they are hammered.

In addition, another advantage of the side-load nail holding hammer is making an improvement in nail digging claws. The side-load nail holding hammer has efficient curved shaped nail digging claws (6) with a small digging claw end (5*a*) and a larger digging claw end (5*b*) that shall not damage the surface from where the nail is being dug or pulled.

Yet another advantage of this invention is that its groove has a self-release design. This characteristic of the side-load nail holding hammer enables the nail to be immediately released after hammering, being self-released from the slot (such as 1*a*, 1*b*, 1*c*, 1*d*, 1*e*) of the nail holder/nail starter where it has been placed, and not being caught in or within the hammer.

BRIEF DESCRIPTION OF DRAWINGS

The present application includes six drawings. The scope of the side-load nail holding hammer is however limited only by the scope of the claims not by a particular embodiment shown in the drawings.

FIG. 1 is a front upper view of hammerhead including the nail starter/holder with nail slots (1*a*) on the sides of the face, the throat (8), a rounded claw body (7), a pair of curved hammer claws (6). with a small claw end (5*a*) and a larger claw end (5*b*).

FIG. 2 is a side view of the hammerhead, including the nail starter/holder with nail slots (1*a*, 1*b*, 1*c*, 1*d*, 1*e*) for nails of diverse sizes, being located at the face (2) and back of the throat (8) of the hammerhead. It also illustrates small magnets (9) in the nail slots to magnetically attract the nails, a neck indentation (3), curved claw body (7), the larger claw end (5*b*), and the eye (10).

FIG. 3 is a bottom view of the hammerhead, including the bottom part of the face (4), the nail holder/starter including diverse half conical shaped nail slots (1*a*, 1*b*, 1*c*, 1*d*, 1*e*) for nails of different sizes, and the eye (10).

DESCRIPTION OF PREFERRED EMBODIMENT/BEST MODE

The present invention embodies an ergonomic, magnetic, side-load nail holding hammer. The elements of one embodiment of this invention are:

(a) A handle made of materials such as but not limited to metals such as but not limited to titanium; wood; fiberglass, rubber, plastic, or man made materials.

Figure 4B:
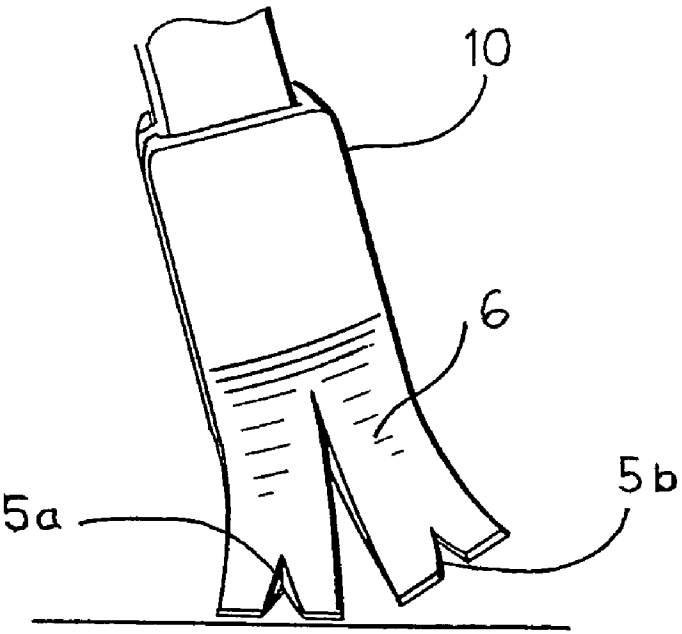
FIG. 4B is a top view of the hammerhead. It includes a pair of claws (6), a small claw end (5*a*), a larger claw end (5*b*), and the eye (10).
Figure 4A:
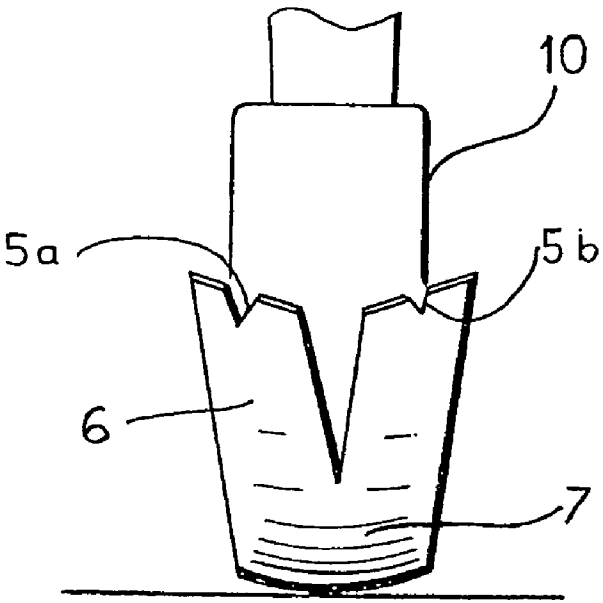
FIG. 4*a* is a top view of the hammerhead including a rounded claw body (7), a pair of claws (6), a small claw end (5*a*), a larger claw end (5*b*), and the eye (10).
Figure 5:
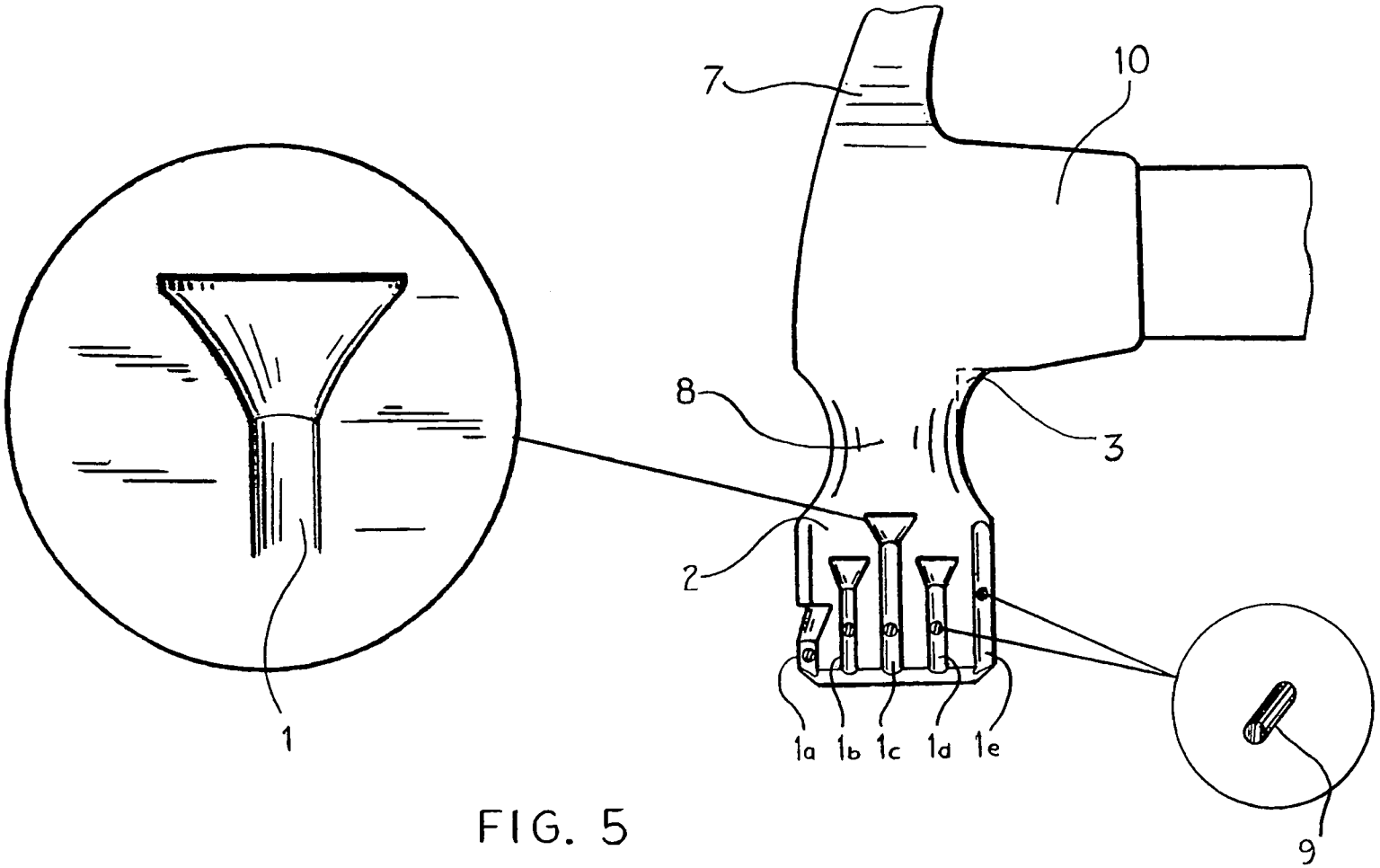
FIG. 5 is a side view of the hammerhead and includes a rounded claw body (7), the eye (10), the throat (8), neck indentation (3), and the nail starter/holder at the face (2) and throat (8) including numerous half conical shaped nail slots (1*a*, 1*b*, 1*c*, 1*d*, 1*e*) and magnets (9). In addition, it has a larger view of a nail slot (1*c*) illustrating the half conical design of the nail slot, as well as a larger view of the magnets (9).

(b) A hammerhead made of metals such as but not limited to titanium and iron, having an eye (10), a pair of curved claws (6), a curved claw body (7), a throat (8), neck with an indentation (3), and striking face (2). As best shown in FIGS. 2 and 5, the indentation (3) is adapted for allowing the head of a larger-sized nail or of a longer-length nail to be positioned about the indentation (3). This indentation (3) feature allows the hammer of the present invention to make a more accurate initial or starter strike to the head of the nail when the hammer is used since the indentation (3) and neck provide more stability to the nail being releasably retained there. The curved claws (6) have a small curved claw end (5*a*) and a larger curved claw end (5*b*), both used for nail digging and removal.

(c) Having said face (2) and throat (8) a nail holder and starter comprised of numerous nail half,conical design vertical slots (such as 1*a*, 1*b*, 1*c*, 1*d*, 1 *e*) for holding nails, permitting placement of nails of diverse size, length and width. In one embodiment and as best shown in FIGS. 2, 3, and 5, slot 1*a*is positioned about a corner of the top surface of the face (2), slots 1*b*, 1*c*, 1*d* are positioned about the side surfaces of the face (2), and slot (1*e*) is positioned about the bottom surface of the face (2). These slots have small magnets (9) attached or drilled to their sides or in them; therefore magnetically attracting the nails to said slots. These slots are also used for starting and straightening nails when hammering and as a self-releasing groove.

Description of Alternate Embodiments

The present invention embodies an ergonomic, magnetic, side-load nail holding hammer. The elements of one embodiment of this invention are:

(a) A handle made of materials such as but not limited to metals such as but not limited to titanium; wood; fiberglass, rubber, plastic, or man made materials.

(b) A hammerhead made of metals such as but not limited to titanium and iron, having an eye (10), a pair of curved claws (6), a curved claw body (7), a throat (8), neck with an indentation (3), and striking face (2). The curved claws (6) have a small curved claw end (5*a*) and a larger curved claw end (5*b*), both used for nail digging and removal.

(c) Having said face (2) and throat (8) a nail holder and starter comprised of numerous nail half,conical design vertical slots (such as 1*a*, 1*b*, 1*c*, 1*d*, 1*e*) for holding nails, permitting placement of nails of diverse size, length and width. These slots have small magnets (9) attached or drilled to their sides or in them; therefore magnetically attracting the nails to said slots. These slots are also used for starting and straightening nails when hammering and as a self-releasing groove.

The invention is not however limited to the above embodiments and materials, for they are given as examples only. The scope of the invention should be determined by its claims not by a particular embodiment of the invention.

I claim:

1. A hammer for releasably retaining nails of varying sizes, said hammer comprising:

a handle;

a hammerhead affixed to said handle, wherein said hammerhead comprises at least one flattened side surface and at least one nail-retention groove of a predetermined size located on said flattened side surface configured so as to align a corresponding selected nail toward a nail striking orientation, wherein said flattened side surface is in a fixed location relative to said hammerhead whereby a nail being received by said at least one nail-retention groove is positioned in a side-loading position at said flattened side surface prior to making contact with an object being struck with the nail, wherein at least one of said at least one nail-retention groove is dimensioned to releasably accept both a shaft of a nail and a head of a nail, and wherein at least one of said at least one nail-retention groove comprises:

a partially cylindrical nail body groove portion of substantially uniform radius within said flattened side surface, and a nail-head groove portion contiguous to said partially cylindrical nail body groove portion configured such that the head of the nail is partially enveloped by said nail-head groove portion; and a magnetic component, disposed within said hammerhead, in magnetic communication with at least one of said at least one nail-retention groove.

2. The hammer according to claim 1, wherein said magnetic component comprises a plurality of magnets, and wherein each of said at least one nail retention groove includes at least one magnet embedded therein.

3. The hammer according to claim 1, wherein said nail-head groove portion has a half conical shape, and wherein said half conical shape comprises a top portion and a slanted body portion.

4. The hammer according to claim 3, wherein said top portion of said half conical shape has a raised height of a predetermined length.

5. The hammer according to claim 1, further comprising:

a pair of flared claws with an inner side portion height and an outer side portion height, wherein said inner side portion height is greater than said outer side portion height such that a rounded upper surface of said flared claws slants downward with respect to a longitudinal median of a top surface of said hammerhead, wherein each of said claws has a claw end defining an interior nail removal void with a width that diminishes into said hammerhead, wherein each of said nail removal voids forms an axis of substantial symmetry that converges with the other, and wherein each of said nail-removal voids is transversely angled such that said nail removal void includes a variable elevation that allows said nail-removal void to be substantially co-planar with the nail-removal surface while said hammerhead is rolled from said claw toward a striking face along said rounded upper surface.

6. The hammer according to claim 5, wherein said rounded upper surface possesses a degree of rounding that continues from said claws to said striking face.

7. A hammer for releasably retaining nails of varying sizes, said hammer comprising:

a handle;

a hammerhead affixed to said handle, wherein said hammerhead comprises a bottom surface and at least one nail-retention groove of a predetermined size located on said bottom surface configured so as to align a corresponding selected nail toward a nail striking orientation, wherein said bottom surface is in a fixed location relative to said hammerhead whereby a nail being received by said at least one nail-retention groove is positioned in a bottom-loading position at said bottom surface prior to making contact with an object being struck with the nail, wherein at least one of said at least one nail-retention groove is dimensioned to releasably accept a shaft of a nail, and wherein at least one of said at least one nail-retention groove comprises a partially cylindrical nail body groove portion of substantially uniform radius within said bottom surface and a nail-head groove portion contiguous to said partially cylindrical nail body groove portion configured such the head of the nail is partially enveloped by said nail-head groove portion; and a magnetic component, disposed within said hammerhead, in magnetic communication with at least one of said at least one nail-retention groove.

8. The hammer according to claim 7, wherein said nail-head groove portion has a half conical shape, and wherein said half conical shape comprises a top portion and a slanted body portion.

9. The hammer according to claim 8, wherein said top portion of said half conical shape has a raised height of a predetermined length.

10. The hammer according to claim 7, wherein said magnetic component comprises a plurality of magnets, and wherein each of said at least one nail retention groove includes at least one magnet embedded therein.

11. The hammer according to claim 7, further comprising:

a pair of flared claws with an inner side portion height and an outer side portion height, wherein said inner side portion height is greater than said outer side portion height such that a rounded upper surface of said flared claws slants downward with respect to a longitudinal median of a top surface of said hammerhead, wherein each of said claws has a claw end defining an interior nail removal void with a width that diminishes into said hammerhead, wherein each of said nail removal voids forms an axis of substantial symmetry that converges with the other, and wherein each of said nail-removal voids is transversely angled such that said nail removal void includes a variable elevation that allows said nail-removal void to be substantially co-planar with the nail-removal surface while said hammerhead is rolled from said claw toward a striking face along said rounded upper surface.

12. The hammer according to claim 11, wherein said rounded upper surface possesses a degree of rounding that continues from said claws to said striking face.

13. A hammer for releasably retaining nails of varying sizes, said hammer comprising:

a handle;

a hammerhead affixed to said handle, wherein said hammerhead comprises a bottom surface, at least one nail-retention groove of a predetermined size located on said bottom surface configured so as to align a corresponding selected nail toward a nail striking orientation, and a neck, wherein said neck includes an indentation, wherein said indentation is located about said bottom surface of said hammerhead, wherein said bottom surface is in a fixed location relative to said hammerhead whereby a nail being received by said at least one nail-retention groove is positioned in a bottom-loading position at said bottom surface prior to making contact with an object being struck with the nail, wherein at least one of said at least one nail-retention groove is dimensioned to releasably accept a shaft of a nail, and wherein at least one of said at least one nail-retention groove comprises a partially cylindrical nail body groove portion of substantially uniform radius within said bottom surface; and a magnetic component, disposed within said hammerhead, in magnetic communication with at least one of said at least one nail-retention groove.

14. the hammer according to claim 13, wherein said magnetic component comprises a plurality of magnets, and wherein each of said at least one nail retention groove includes at least one magnet embedded therein.

15. The hammer according to claim 13, further comprising:

a pair of flared claws with an inner side portion height and an outer side portion height, wherein said inner side portion height is greater than said outer side portion height such that a rounded upper surface of said flared claws slants downward with respect to a longitudinal median of a top surface of said hammerhead, wherein each of said claws has a claw end defining an interior nail removal void with a width that diminishes into said hammerhead, wherein each of said nail removal voids forms an axis of substantial symmetry that converges with the other, and wherein each of said nail-removal voids is transversely angled such that said nail removal void includes a variable elevation that allows said nail-removal void to be substantially co-planar with the nail-removal surface while said hammerhead is rolled from said claw toward a striking face along said rounded upper surface.

16. The hammer according to claim 15, wherein said rounded upper surface possesses a degree of rounding that continues from said claws to said striking face.

17. A hammer for releasably retaining nails of varying sizes, said hammer comprising:

a handle;

a hammerhead affixed to said handle, wherein said hammerhead comprises a pair of curved claws, a curved claw body, a throat, a neck, and a striking face, wherein at least one of said curved claws has a small curved claw end and a larger curved claw end, wherein said throat and said striking face comprising at least one flattened side surface, at least one nail-retention groove of a predetermined size located on said flattened side surface configured so as to align a corresponding selected nail toward a nail striking orientation, a bottom surface, and at least one nail-retention groove of a predetermined size located on said bottom surface configured so as to align a corresponding selected nail toward a nail striking orientation, wherein said flattened side surface is in a fixed location relative to said hammerhead whereby a nail being received by said at least one nail-retention groove located on said flattened side surface is positioned in a side-loading position at said flattened side surface prior to making contact with an object being struck with the nail, wherein said bottom side surface is in a fixed location relative to said hammerhead whereby a nail being received by said at least one nail-retention groove located on said bottom surface is positioned in a bottom-loading position at said bottom surface prior to making contact with an object being struck with the nail, wherein at least one of said at least one nail-retention groove located on said flattened side surface is dimensioned to releasably accept both a shaft of a nail and a head of a nail, wherein at least one of said at least one nail-retention groove located on said bottom surface is dimensioned to releasably accept a shaft of a nail, wherein at least one of said at least one nail-retention groove located on said flattened side surface comprises:

a partially cylindrical nail body groove portion of substantially uniform radius within said flattened side surface, and a nail-head groove portion contiguous to said partially cylindrical nail body groove portion configured such that the head of the nail is partially enveloped by said nail-head groove portion, wherein at least one of said at least one nail-retention groove located on said bottom surface comprises a partially cylindrical nail body groove portion of substantially uniform radius within said bottom surface; and a magnetic component, disposed within said hammerhead, in magnetic communication with at least one of said at least one nail-retention groove located on said flattened side surface and with at least one of said at least one nail-retention groove located on said bottom surface.

18. The hammer according to claim 17, wherein said neck includes an indentation.

19. The hammer according to claim 18, wherein said nail-head groove portion of said at least one nail-retention groove located on said flattened side surface has a half conical shape, and wherein said half conical shape comprises a top portion and a slanted body portion.

20. The hammer according to claim 19, wherein said top portion of said half conical shape has a raised height of a predetermined length.

21. The hammer according to claim 18, wherein said hammerhead further comprises an eye.

22. The hammer according to claim 18, wherein said magnetic component comprises a plurality of magnets, and wherein each of said nail retention grooves includes at least one magnet embedded therein.

23. The hammer according to claim 17, wherein said nail-head groove portion of said at least one nail-retention groove located on said flattened side surface has a half conical shape, and wherein said half conical shape comprises a top portion and a slanted body portion.

24. The hammer according to claim 23, wherein said top portion of said half conical shape has a raised height of a predetermined length.

25. The hammer according to claim 17, wherein said at least one of said at least one nail-retention groove located on said bottom surface further comprises a nail-head groove portion contiguous to said partially cylindrical nail body groove portion of said at least one nail-retention groove located on said bottom surface configured such that the head of the nail is partially enveloped by said nail-head groove portion of said at least one nail-retention groove located on said bottom surface.

26. The hammer according to claim 25, wherein said nail-head groove portion of said at least one nail-retention groove located on said bottom side surface has a half conical shape, and wherein said half conical shape comprises a top portion and a slanted body portion.

27. The hammer according to claim 26, wherein said top portion of said half conical shape has a raised height of a predetermined length.

28. The hammer according to claim 17, wherein said magnetic component comprises a plurality of magnets, and wherein each of said nail retention grooves includes at least one magnet embedded therein.

29. The hammer according to claim 17, wherein said hammerhead further comprises an eye.

* * * * *